US009316955B2

(12) United States Patent
Meguro

(10) Patent No.: US 9,316,955 B2
(45) Date of Patent: Apr. 19, 2016

(54) CLEANING DEVICE AND IMAGE FORMING APPARATUS

(71) Applicant: Konica Minolta, Inc., Tokyo (JP)

(72) Inventor: Taichi Meguro, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/593,360

(22) Filed: Jan. 9, 2015

(65) Prior Publication Data

US 2015/0370198 A1 Dec. 24, 2015

(30) Foreign Application Priority Data

Jan. 21, 2014 (JP) ..... 2014-008483

(51) Int. Cl.
*G03G 15/16* (2006.01)

(52) U.S. Cl.
CPC ..... *G03G 15/161* (2013.01)

(58) Field of Classification Search
CPC ..... G03G 15/161; G03G 15/168; G03G 2221/001
See application file for complete search history.

(56) References Cited

U.S. PATENT DOCUMENTS

| | | | | |
|---|---|---|---|---|
| 5,912,100 | A * | 6/1999 | Aoki et al. | 430/108.7 |
| 2008/0101834 | A1* | 5/2008 | Iwasaki | 399/357 |
| 2012/0008973 | A1* | 1/2012 | Sakakibara et al. | 399/71 |
| 2012/0224870 | A1* | 9/2012 | Kikuchi et al. | 399/44 |

FOREIGN PATENT DOCUMENTS

| | | | |
|---|---|---|---|
| JP | 2008122625 | A | 5/2008 |
| JP | 2010014876 | A | 1/2010 |
| JP | 2011065085 | A | 3/2011 |
| JP | 2012-088668 | A | 5/2012 |
| JP | 2013054222 | A | 3/2013 |

OTHER PUBLICATIONS

Japanese Office Action; Reference No. B32123JP01; Dispatch No. 588493; Dispatch Date Jan. 5, 2016; Notice of Reasons for Rejection; Japanese Patent Application No. 2014-008483; Drafting Date Dec. 22, 2015; Representative: Kimihito Washida et al; total of 7 pages. English translation of Japanese Japanese Office Action; total of 3 pages.

* cited by examiner

*Primary Examiner* — David Gray
*Assistant Examiner* — Thomas Giampaolo, II
(74) *Attorney, Agent, or Firm* — Lucas & Mercanti, LLP

(57) ABSTRACT

A cleaning device includes a pre-cleaning section and a first cleaning section. The pre-cleaning section includes a pre-cleaning roller and a pre-bias power source that applies a voltage having a polarity opposite to a regular charging polarity of toner to the pre-cleaning roller such that toner passing over the pre-cleaning roller is oppositely charged to the polarity opposite to the regular charging polarity. The first cleaning section includes a first cleaning roller and a first bias power source that applies a voltage having the polarity opposite to the regular charging polarity of toner to the first cleaning roller such that toner having the polarity identical to the regular charging polarity electrostatically attaches to the first cleaning roller from the transfer belt when a predetermined cleaning condition is satisfied.

20 Claims, 6 Drawing Sheets

CLEANING DEVICE AND IMAGE FORMING APPARATUS

CROSS REFERENCE TO RELATED APPLICATIONS

This application is entitled and claims the benefit of Japanese Patent Application No. 2014-008483, filed on Jan. 21, 2014, the disclosure of which including the specification, drawings and abstract is incorporated herein by reference in its entirety.

BACKGROUND OF THE INVENTION

1. Field of the Invention

The present invention relates to a cleaning device and an image forming apparatus.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor (image carrier) on which the electrostatic latent image is formed, whereby a toner image is formed. Further, the toner image is directly or indirectly transferred to a sheet, followed by heating and pressurization, whereby an image is formed on the sheet.

In an image forming apparatus of an intermediate transfer belt type and the like, a toner image formed on a photoconductor drum is temporarily transferred to an intermediate transfer belt, and then the toner image transferred on the intermediate transfer belt is transferred to a recording sheet. In this process, the toner is not completely transferred to the recording sheet, and remains on the surface of the intermediate transfer belt. The remaining toner hinders subsequent image forming, and causes a problem that a favorable transfer image cannot be obtained. Under such circumstances, image forming apparatuses are provided with a cleaning device for removing toner.

The cleaning device is provided with a cleaning member that removes the toner on the surface of the intermediate transfer belt. In particular, in image forming apparatuses for use in light-duty printing such as production printing, a large amount of toner is frequently transferred to the intermediate transfer belt. Therefore, it is desirable that, in image forming apparatuses for production printing, the cleaning member have a function for instantly removing a large amount of toner. To ensure such a removing function, cleaning brushes have been used as the cleaning member.

As a technique in which a cleaning brush is used as a cleaning member, a technique has been proposed in which the pre-cleaning brush roller to which a voltage having a polarity opposite to the regular charging polarity of toner is applied so as to electrostatically remove toner having the regular charging polarity is disposed on the upstream of a charging toner cleaning brush roller and an oppositely charging toner cleaning brush roller in a surface-traveling direction of an intermediate transfer belt. Here, the regular charging toner cleaning brush roller electrostatically removes toner having a regular charging polarity, and the oppositely charging toner cleaning brush roller electrostatically removes toner having a polarity opposite to the regular charging polarity (see, for example, Japanese Patent Application Laid-Open No. 2012-88668).

However, in the technique disclosed in the above-mentioned Japanese Patent Application Laid-Open No. 2012-88668, depending on the cleaning condition, a function of oppositely charging toner having the regular charging polarity that passes through the pre-cleaning brush roller may be impaired. In this case, disadvantageously, toner that has passed through the pre-cleaning brush roller cannot be sufficiently removed by the regular charging toner cleaning brush roller and the oppositely charging toner cleaning brush roller that are disposed on the downstream of the pre-cleaning brush roller.

SUMMARY OF THE INVENTION

An object of the present invention is to provide a cleaning device and an image forming apparatus which can achieve favorable cleaning for a transfer belt on which toner remains.

To achieve the abovementioned object, a cleaning device reflecting one aspect of the present invention includes a pre-cleaning section and a first cleaning section, the pre-cleaning section including a pre-cleaning roller configured to remove toner remaining on a transfer belt, and a pre-cleaning voltage applying section configured to apply a voltage having a polarity opposite to a regular charging polarity of the toner to the pre-cleaning roller such that the toner having the regular charging polarity electrostatically attaches to the pre-cleaning roller from the transfer belt, and that the toner passing over the pre-cleaning roller is oppositely charged to the polarity opposite to the regular charging polarity, the first cleaning section including a first cleaning roller disposed on a downstream side of the pre-cleaning roller in a traveling direction of the transfer belt, the first cleaning roller being configured to remove toner remaining on the transfer belt, and a first cleaning voltage applying section configured to apply a voltage having a polarity identical to the regular charging polarity of the toner to the first cleaning roller such that the toner having the polarity opposite to the regular charging polarity attaches to the first cleaning roller from the transfer belt, the first cleaning voltage applying section being configured to apply a voltage having the polarity opposite to the regular charging polarity of the toner to the first cleaning roller such that the toner having the polarity identical to the regular charging polarity electrostatically attaches to the first cleaning roller from the transfer belt only when a predetermined cleaning condition is satisfied.

Desirably, in the cleaning device, brush bristles are not provided on a periphery of the pre-cleaning roller.

Desirably, in the cleaning device, the cleaning condition is that a belt width of the toner is 100 [mm] or smaller.

Desirably, in the cleaning device, the cleaning condition is that an attached amount of the toner is 6 [$g/m^2$] or more.

Desirably, in the cleaning device, the cleaning condition is that a temperature around the cleaning device is 10[° C.] or below, and that a humidity around the cleaning device is 20[%] or below.

Desirably, in the cleaning device, the first cleaning roller is a cleaning brush roller.

Desirably, in the cleaning device, the first cleaning roller makes contact with a surface of the transfer belt, and rotates in a counter direction opposite to the traveling direction of the transfer belt.

Desirably, in the cleaning device, the first cleaning section includes a first cleaning counter roller that is so arranged as to make pressure contact with the transfer belt at a predetermined position, and to face the first cleaning roller with the transfer belt therebetween.

Desirably, the cleaning device further includes a second cleaning section, the second cleaning section including a second cleaning roller disposed on a downstream side of the first cleaning roller in the traveling direction of the transfer belt, the second cleaning roller being configured to remove toner remaining on the transfer belt, and a second cleaning voltage applying section configured to apply a voltage having the polarity opposite to the regular charging polarity of the toner to the second cleaning roller such that the toner having the polarity identical to the regular charging polarity attaches to the second cleaning roller from the transfer belt, the second cleaning voltage applying section being configured to apply a voltage having the polarity identical to the regular charging polarity of the toner to the second cleaning roller such that the toner having the polarity opposite to the regular charging polarity electrostatically attaches to the second cleaning roller from the transfer belt only when a predetermined cleaning condition is satisfied.

Desirably, in the cleaning device, the second cleaning roller is a cleaning brush roller.

Desirably, in the cleaning device, the second cleaning roller makes contact with a surface of the transfer belt, and rotates in a counter direction opposite to the traveling direction of the transfer belt.

Desirably, in the cleaning device, the second cleaning section includes a second cleaning counter roller that is so arranged as to make pressure contact with the transfer belt at a predetermined position, and to face the second cleaning roller with the transfer belt therebetween.

An image forming apparatus reflecting another aspect of the present invention includes: a pre-cleaning section and a first cleaning section, the pre-cleaning section including a pre-cleaning roller configured to remove toner remaining on a transfer belt, and a pre-cleaning voltage applying section configured to apply a voltage having a polarity opposite to a regular charging polarity of the toner to the pre-cleaning roller such that the toner having the regular charging polarity electrostatically attaches to the pre-cleaning roller from the transfer belt, and that the toner passing over the pre-cleaning roller is oppositely charged to the polarity opposite to the regular charging polarity, the first cleaning section including a first cleaning roller disposed on a downstream side of the pre-cleaning roller in a traveling direction of the transfer belt, the first cleaning roller being configured to remove toner remaining on the transfer belt, and a first cleaning voltage applying section configured to apply a voltage having a polarity identical to the regular charging polarity of the toner to the first cleaning roller such that the toner having the polarity opposite to the regular charging polarity attaches to the first cleaning roller from the transfer belt, the first cleaning voltage applying section being configured to apply a voltage having the polarity opposite to the regular charging polarity of the toner to the first cleaning roller such that the toner having the polarity identical to the regular charging polarity electrostatically attaches to the first cleaning roller from the transfer belt only when a predetermined cleaning condition is satisfied.

Desirably, in the image forming apparatus, brush bristles are not provided on a periphery of the pre-cleaning roller.

Desirably, in the image forming apparatus, the cleaning condition is that a belt width of the toner is 100 [mm] or smaller.

Desirably, in the image forming apparatus, the cleaning condition is that an attached amount of the toner is 6 [g/m$^2$] or more.

Desirably, in the image forming apparatus, the cleaning condition is that a temperature around the image forming apparatus is 10[° C.] or below, and that a humidity around the image forming apparatus is 20[%] or below.

Desirably, in the image forming apparatus, the first cleaning roller is a cleaning brush roller.

Desirably, the image forming apparatus further includes a second cleaning section, the second cleaning section including a second cleaning roller disposed on a downstream side of the first cleaning roller in the traveling direction of the transfer belt, the second cleaning roller being configured to remove toner remaining on the transfer belt, and a second cleaning voltage applying section configured to apply a voltage having the polarity opposite to the regular charging polarity of the toner to the second cleaning roller such that the toner having the polarity identical to the regular charging polarity attaches to the second cleaning roller from the transfer belt, the second cleaning voltage applying section being configured to apply a voltage having the polarity identical to the regular charging polarity of the toner to the second cleaning roller such that the toner having the polarity opposite to the regular charging polarity electrostatically attaches to the second cleaning roller from the transfer belt only when a predetermined cleaning condition is satisfied.

Desirably, in the image forming apparatus, the second cleaning roller is a cleaning brush roller.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
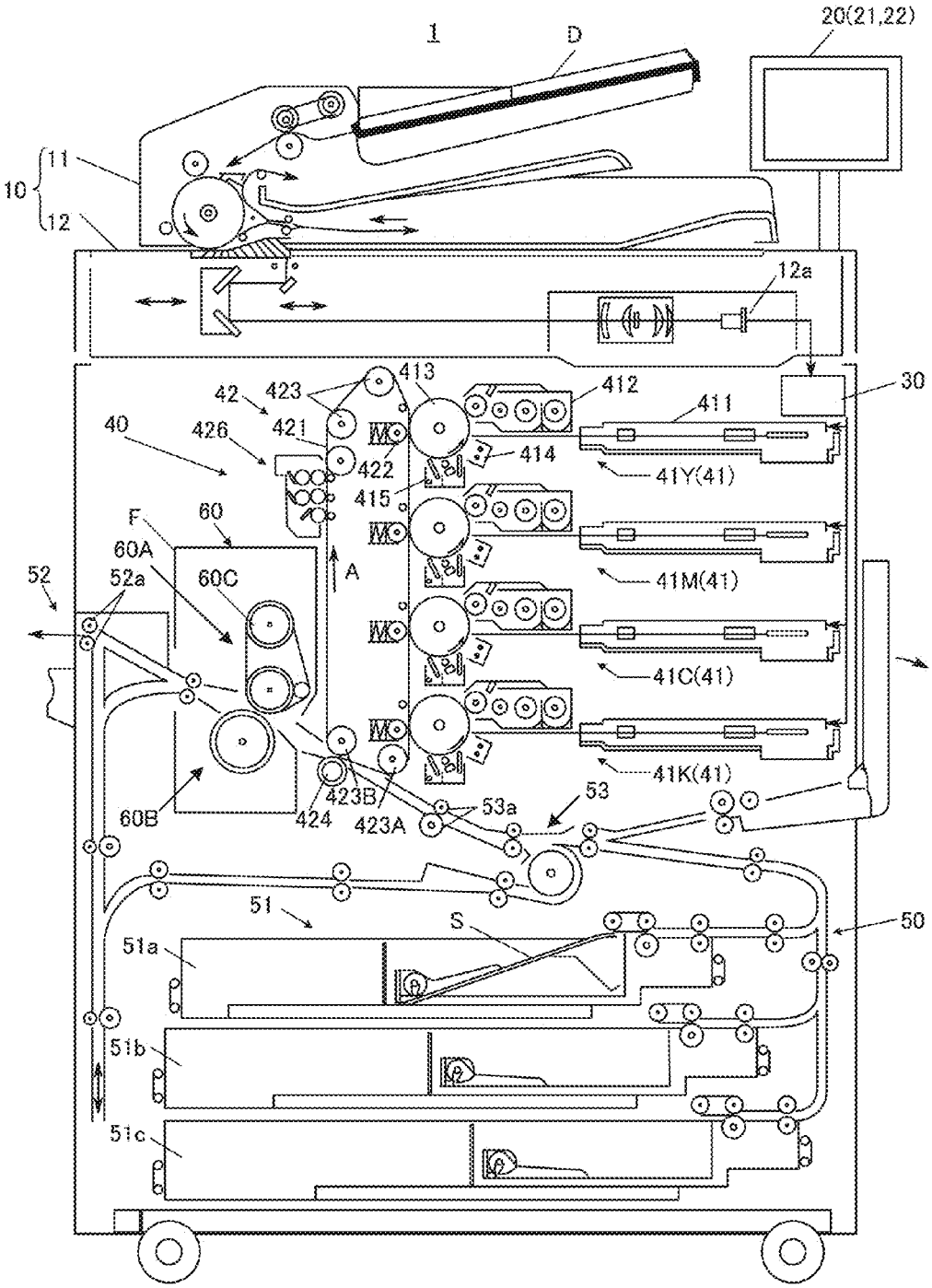
FIG. 1 schematically illustrates a general configuration of an image forming apparatus of the present embodiment.
Figure 2:
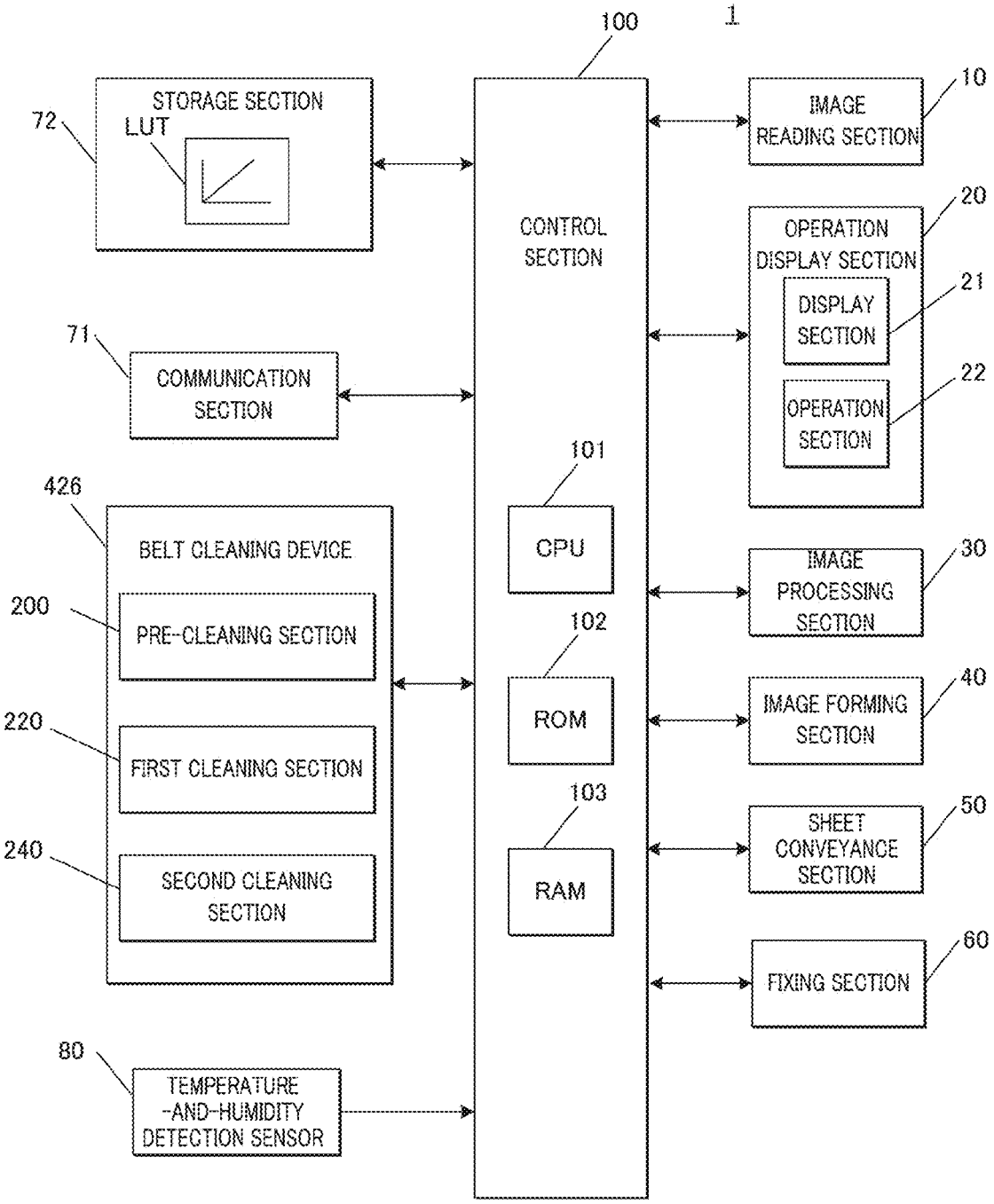
FIG. 2 illustrates a principal part of a control system of the image forming apparatus of the present embodiment.

In the following, an embodiment is described in detail with reference to the drawings. FIG. 1 illustrates an overall configuration of image forming apparatus 1 according to the embodiment of the present invention. FIG. 2 illustrates a principal part of a control system of image forming apparatus 1 according to the embodiment. Image forming apparatus 1 illustrated in FIGS. 1 and 2 is a color image forming apparatus with an intermediate transfer system using electrophotographic process technology. That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondary-transfers) the resultant image to sheet S, to thereby form an image.

A longitudinal tandem system is adopted for image forming apparatus 1. In the longitudinal tandem system, respective photoconductor drums 413 corresponding to the four colors of YMCK are placed in series in the traveling direction (vertical direction) of intermediate transfer belt 421, and the toner images of the four colors are sequentially transferred to intermediate transfer belt 421 in one cycle.

As illustrated in FIG. 2, image forming apparatus 1 includes image reading section 10, operation display section 20, image processing section 30, image forming section 40, sheet conveyance section 50, fixing section 60, and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

Image reading section 10 includes auto document feeder (ADF) 11, document image scanner (scanner) 12, and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image statuses, the operating conditions of each function, and the like in accordance with display control signals received from control section 100. Operation section 22 includes various operation keys such as a numeric keypad and a start key, receives various input operations performed by a user, and outputs operation signals to control section 100.

Image processing section 30 includes a circuit that performs digital image processing suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K for images of colored toners respectively containing a Y component, an M component, a C component, and a K component on the basis of the input image data; intermediate transfer unit 42; and the like.

Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, drum cleaning device 415 and the like.

Photoconductor drums 413 are, for example, negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 [mm] The charge generation layer is made of an organic semiconductor in which a charge generating material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 100 controls a driving current supplied to a driving motor (not shown in the drawings) that rotates photoconductor drums 413, whereby photoconductor drums 413 is rotated at a constant circumferential speed.

Charging device 414 evenly negatively charges the surface of photoconductor drum 413. Exposure device 411 is composed of, for example, a semiconductor laser, and configured to irradiate photoconductor drum 413 with laser light corresponding to the image of each color component. Since the positive charge is generated in the charge generation layer of photoconductor drum 413 and is transported to the surface of the charge transport layer, the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component developing type, and attaches toners of respective color components to the surface of photoconductor drums 413, and visualizes the electrostatic latent image to form a toner image.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt traveling direction relative to primary transfer rollers 422 for K-component is a driving roller. With this configuration, the traveling speed of the belt at a primary transfer section can be easily maintained at a constant speed. When driving roller 423A rotates, intermediate transfer belt 421 travels in an arrow A direction at a constant speed.

Intermediate transfer belt 421 is a belt having conductivity and elasticity which includes on the surface thereof a high resistance layer having a volume resistivity of 8 to 11 [log Ω·cm]. Both toner 190 having positive polarity (polarity opposite to the regular charging polarity) and toner 190 having negative polarity (regular charging polarity) remain on intermediate transfer belt 421 in a mixed state. Intermediate transfer belt 421 is rotationally driven by a control signal from control section 100. It is to be noted that the material, thickness and hardness of intermediate transfer belt 421 are not limited as long as intermediate transfer belt 421 has conductivity and elasticity.

Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face roller 423B (hereinafter referred to as "backup roller 423B") disposed on the downstream side in the belt traveling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and electric charge of the polarity opposite to the polarity of the toner is applied to the rear side (the side that makes contact with secondary transfer roller 424) of sheet S, whereby the toner image is electrostatically transferred to sheet S. Sheet S on which the toner images have been transferred is conveyed toward fixing section 60.

Belt cleaning device 426 (which corresponds to the "cleaning device" of the embodiment of the present invention) includes a belt cleaning blade that is brought into sliding contact with the surface of intermediate transfer belt 421 (which corresponds to the "transfer belt" of the embodiment of the present invention), and removes residual toner that remains on the surface of intermediate transfer belt 421 after the secondary transfer. The specific configurations of belt cleaning device 426 will be described later. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing side member disposed on a fixing surface (the surface on which a toner image is formed) of sheet S, lower fixing section 60B having a back side supporting member disposed on the rear surface (the surface opposite to the fixing surface) side of sheet S, heating source 60C, and the like. Back side supporting member is brought into pressure contact with the fixing side member, whereby a fixing nip for conveying sheet S in a tightly sandwiching manner is formed.

Fixing section 60 applies, at the fixing nip, heat and pressure to sheet S on which a toner image has been secondary-transferred, thereby fixing the toner image on sheet S. Fixing section 60 is disposed as a unit in fixing part F. In addition, fixing part F may be provided with an air-separating unit that blows air to separate sheet S from the fixing side member or the back side supporting member.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of pairs of conveyance rollers such as a pair of registration rollers 53*a*.

The recording sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet discharging rollers 52*a*.

[Configuration of Main Part of Belt Cleaning Device 426]

Figure 3:
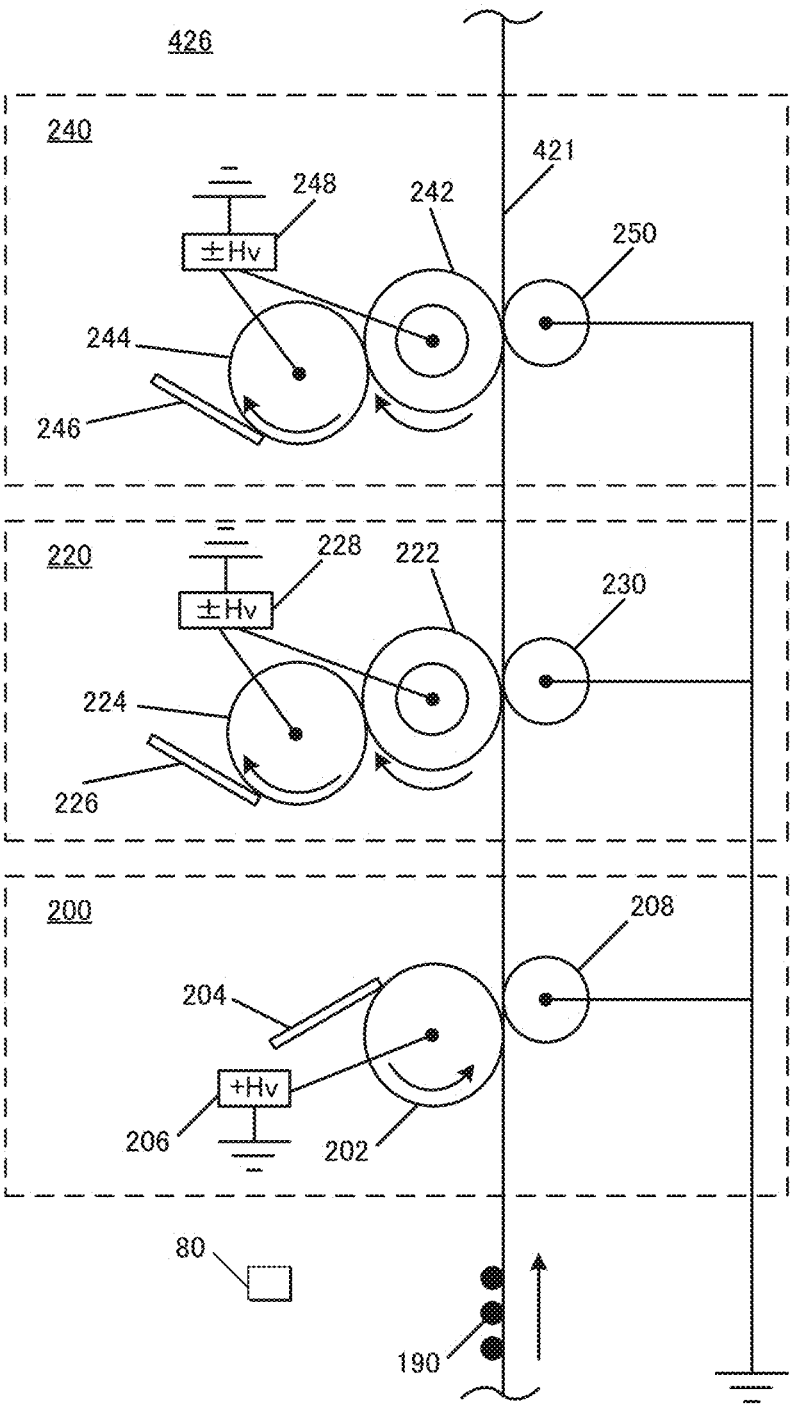
FIG. 3 illustrates a configuration of a belt cleaning device of the present embodiment.

Next, with reference to FIG. 3, the configuration of the main part of belt cleaning device 426 will be described. Belt cleaning device 426 includes pre-cleaning section 200, first cleaning section 220 and second cleaning section 240. In the proximity of pre-cleaning section 200, or more specifically, on the upstream side of first cleaning section 220 in the traveling direction of intermediate transfer belt 421, temperature-and-humidity detection sensor 80 is provided. Temperature-and-humidity detection sensor 80 detects the temperature and humidity around belt cleaning device 426. Every time the temperature and humidity around belt cleaning device 426 are measured, temperature-and-humidity detection sensor 80 outputs temperature-and-humidity information pertaining to the temperature and humidity to control section 100.

Pre-cleaning section 200 includes pre-cleaning roller 202, pre-scraper 204 (scraping member), pre-bias power source 206 (pre-cleaning voltage applying section), and pre-cleaning counter roller 208.

Brush bristles are not provided on the periphery of pre-cleaning roller 202, and pre-cleaning roller 202 includes a mandrel and an elastic layer that covers the outer periphery of the mandrel. The material of the mandrel is a metal such as aluminum, for example. The material of the elastic layer is a polyurethane foam having conductivity, for example. Pre-cleaning roller 202 is disposed in such a manner that pre-cleaning roller 202 is rotatable while making contact with intermediate transfer belt 421. Pre-cleaning roller 202 is a cleaning roller configured to remove toner 190 having negative polarity (regular charging polarity) remaining on intermediate transfer belt 421. From the view point of preventing the surface of intermediate transfer belt 421 from being damaged by the rubbing between pre-cleaning roller 202 and intermediate transfer belt 421, pre-cleaning roller 202 is rotationally driven by a control signal from control section 100 in a with direction (a rotational direction in which the surfaces facing each other move in the same direction) with respect to intermediate transfer belt 421. In order to favorably remove toner 190 on intermediate transfer belt 421, control section 100 controls the rotation speed of pre-cleaning roller 202 such that the rotation speed ratio θ (=V2/V1) between the rotation speed (V1) of pre-cleaning roller 202 and the rotation speed (V2) of intermediate transfer belt 421 satisfies $0.8 \leq \theta \leq 1.2$.

It is to be noted that, by performing a metal plating treatment on pre-cleaning roller 202, a desired hardness of pre-cleaning roller 202 can be ensured. When the metal plating treatment is an electroless plating treatment, a highly uniform thin film can be formed on the surface of pre-cleaning roller 202. When the electroless plating treatment is an electroless nickel plating, the cost of the electroless plating treatment is reduced, and filming phenomenon is prevented from occurring on the surface of pre-cleaning roller 202. The filming phenomenon is a phenomenon in which toner, toner additive, paper dust, discharge products, and the like are attached on the surface of intermediate transfer belt 421. By setting the hardness (surface-Vickers hardness) of the metal plating layer formed by the metal plating treatment to 350 [$Kg/mm^2$] or greater, it is possible to prevent roughening on the surface of pre-cleaning roller 202 due to the toner convection at pre-scraper 204. In addition, by setting the surface roughness (Rz) of the metal plating layer to 1.0 [μm] or smaller, it is possible to ensure the scraping performance of pre-scraper 204 in the case where the image formation process have been performed for long periods of time, and to prevent the filming phenomenon from occurring on the surface of pre-cleaning roller 202.

Pre-scraper 204 is a plate made of a metal, or an elastic blade made of elastomer. An end portion of pre-scraper 204 is pressed against pre-cleaning roller 202, and thus pre-scraper 204 mechanically scrapes toner 190 attached on the surface of pre-cleaning roller 202. From the view point of achieving favorable scraping performance, pre-scraper 204 makes contact with the surface of pre-cleaning roller 202 in a counter direction (a rotational direction in which the surfaces facing each other move in opposite directions). The contact linear load and effective contact angle of pre-scraper 204 on the surface of pre-cleaning roller 202 are respectively 50 to 180 [N/m] and 35 to 45 degrees. It is to be noted that, as long as the above-described condition of the linear load is satisfied, the material, thickness and hardness of pre-scraper 204 are not limited.

Pre-cleaning counter roller 208 includes a mandrel, and an elastic layer that covers the outer periphery of the mandrel. The material of the mandrel is a metal such as aluminum, for example. The material of the elastic layer is a rubber material such as a conductive polyurethane foam and ethylene propylene diene polymer (EPDM), elastomer or the like, and the material of the elastic layer is not limited as long as the material has a predetermined electrical property. In the present embodiment, in order that pre-cleaning roller 202 can favorably remove toner 190 on intermediate transfer belt 421, the material of the elastic layer is EPDM and the elastic layer includes a high resistance layer having a volume resistivity of 2 to 8 [log Ω·cm]. Pre-cleaning counter roller 208 is mounted in a freely rotatable manner, and follows the rotation of intermediate transfer belt 421. That is, pre-cleaning counter roller 208 is rotationally driven at the same rotation speed as intermediate transfer belt 421.

Pre-cleaning counter roller 208 is provided in such a manner that it faces pre-cleaning roller 202 with intermediate transfer belt 421 therebetween. Pre-cleaning counter roller 208 is pressed by a pressing spring (not illustrated) toward intermediate transfer belt 421 at a predetermined pressure (for example, 6 [N/m]). Thus, a uniform cleaning nip at which the surface of intermediate transfer belt 421 and pre-cleaning roller 202 make contact with each other is formed. In addition, in order to achieve favorable cleaning performance while sufficiently ensuring the width of the cleaning nip, pre-cleaning counter roller 208 is disposed in such a manner as to be shifted to the downstream side in the traveling direction of intermediate transfer belt 421 (upward in the drawing, the same shall apply hereinafter), by a predetermined distance (for example, 1 to 3 [mm]) from pre-cleaning roller 202. Pre-cleaning counter roller 208 is grounded, and thus the electric charge accumulated to intermediate transfer belt 421 can be released to the ground.

Pre-bias power source 206 is connected to pre-cleaning roller 202, and applies a predetermined voltage to pre-cleaning roller 202. The voltage application operation of pre-bias power source 206 is controlled by control section 100. It is to be noted that the power supply mode of pre-bias power source 206 may be either the constant current control or the constant voltage control. It should be noted that, to securely ensure a potential difference, the constant voltage control is preferable.

In response to a control signal from control section 100, pre-bias power source 206 applies a positive bias voltage to pre-cleaning roller 202. In addition, pre-cleaning counter roller 208 is grounded. Thus, between intermediate transfer belt 421 and pre-cleaning roller 202, an electrostatic force in the direction from intermediate transfer belt 421 toward pre-cleaning roller 202 acts on negative toner 190 remaining on intermediate transfer belt 421. As a result, negative toner 190 remaining on intermediate transfer belt 421 attaches to pre-cleaning roller 202. Thereafter, toner 190 attached on pre-cleaning roller 202 is scraped from the surface of pre-cleaning roller 202 by pre-scraper 204.

First cleaning section 220 is disposed on the downstream side of pre-cleaning section 200 in the traveling direction of intermediate transfer belt 421. First cleaning section 220 includes first cleaning roller 222, first collecting roller 224, first scraper 226, first bias power source 228 (first cleaning voltage applying section) and first cleaning counter roller 230.

First cleaning roller 222 is a cleaning brush roller in which a plurality of elastic conductive fibers (for example, acrylic resin) are planted on the surface of a rotation member. First cleaning roller 222 is disposed in such a manner that first cleaning roller 222 is rotatable while making contact with intermediate transfer belt 421, and removes positive toner 190 (toner 190 oppositely charged to positive polarity at pre-cleaning roller 202 and toner 190 having positive polarity at the time of entering pre-cleaning roller 202) remaining on intermediate transfer belt 421. In order to favorably remove toner 190 on intermediate transfer belt 421, first cleaning roller 222 is rotationally driven by a control signal from control section 100 in a counter direction with respect to intermediate transfer belt 421.

First collecting roller 224 is a cylindrical roller in which the surface of a mandrel made of stainless-steel or the like is covered with an acrylic UV curable resin layer (resistance layer). First collecting roller 224 is a roller which is configured to collect the toner 190 attached on the surface of first cleaning roller 222. Therefore, first collecting roller 224 is disposed in such a manner that first collecting roller 224 is rotatable while making contact with a conductive fiber of first cleaning roller 222 at part of the outer surface of first collecting roller 224. The surface of first collecting roller 224 may be, for example, plated in order to enhance smoothness and durability. First collecting roller 224 is rotationally driven by a control signal from control section 100 in a counter direction with respect to first cleaning roller 222.

First scraper 226 is a plate made of a metal, or an elastic blade made of elastomer. An end portion of first scraper 226 is pressed against first collecting roller 224, and thus first scraper 226 mechanically scrapes toner 190 attached on the surface of first collecting roller 224.

First cleaning counter roller 230 is a cylindrical roller made of a metal such as iron, aluminum, and stainless-steel. First cleaning counter roller 230 is mounted in a freely rotatable manner, and follows the rotation of intermediate transfer belt 421. That is, first cleaning counter roller 230 is rotationally driven at the same rotation speed as intermediate transfer belt 421.

First cleaning counter roller 230 is provided in such a manner as to face first cleaning roller 222 with intermediate transfer belt 421 therebetween and to make pressure contact with intermediate transfer belt 421 at a predetermined position. This configuration is intended to form a uniform cleaning nip at which the surface of intermediate transfer belt 421 and first cleaning roller 222 make contact with each other, and to achieve favorable cleaning performance by sufficiently ensuring the width of the cleaning nip. First cleaning counter roller 230 is pressed by a pressing spring (not illustrated) toward intermediate transfer belt 421 at a predetermined pressure (for example, 6 [N/m]). Further, since first cleaning counter roller 230 is a relatively hard metal roller, a uniform cleaning nip at which the surface of intermediate transfer belt 421 and first cleaning roller 222 make contact with each other is formed. In addition, in order to achieve favorable cleaning performance while sufficiently ensuring the width of the cleaning nip, first cleaning counter roller 230 is disposed in such a manner as to be shifted to the downstream side in the traveling direction of intermediate transfer belt 421 (upward in the drawing, the same shall apply hereinafter), by a predetermined distance (for example, 2 [mm]) from first cleaning roller 222. First cleaning counter roller 230 is grounded, and thus the electric charge accumulated to intermediate transfer belt 421 can be released to the ground.

First bias power source 228 is connected to first cleaning roller 222 and first collecting roller 224, and applies a predetermined voltage to first cleaning roller 222 and first collecting roller 224. The voltage application operation of first bias power source 228 is controlled by control section 100. It is to be noted that the power supply mode of first bias power source 228 may be either the constant current control or the constant voltage control. It should be noted that, to securely ensure a potential difference, the constant voltage control is preferable.

In response to a control signal from control section 100, first bias power source 228 applies a negative bias voltage to first cleaning roller 222. In addition, first cleaning counter roller 230 is grounded. Thus, between intermediate transfer belt 421 and first cleaning roller 222, an electrostatic force in the direction from intermediate transfer belt 421 toward first cleaning roller 222 acts on positive toner 190 remaining on intermediate transfer belt 421. As a result, positive toner 190 remaining on intermediate transfer belt 421 attaches to first cleaning roller 222. Thereafter, toner 190 attached on first cleaning roller 222 is oppositely charged from positive to negative, by a bias voltage applied to first cleaning roller 222.

In response to a control signal from control section 100, first bias power source 228 applies a negative bias voltage to first collecting roller 224. That is, the potentials of first cleaning roller 222 and first collecting roller 224 are set to potentials having the same polarity (negative polarity) and different values. Thus, between first cleaning roller 222 and first collecting roller 224, an electrostatic force in the direction from first cleaning roller 222 toward first collecting roller 224 acts on negatively and oppositely charged toner 190. Toner 190 that has moved to first collecting roller 224 is scraped from the surface of first collecting roller 224 by first scraper 226.

Second cleaning section 240 is disposed on the downstream side of first cleaning section 220 in the traveling direction of intermediate transfer belt 421. Second cleaning section 240 includes second cleaning roller 242, second collecting roller 244, second scraper 246, second bias power source 248 (second cleaning voltage applying section) and second cleaning counter roller 250. Second cleaning section 240 has substantially the same configuration as first cleaning section 220. While first cleaning section 220 removes positive toner 190, second cleaning section 240 removes negative toner 190.

Second bias power source 248 is connected to second cleaning roller 242 and second collecting roller 244, and applies a predetermined voltage to second cleaning roller 242 and second collecting roller 244. The voltage application operation of second bias power source 248 is controlled by control section 100. It is to be noted that the power supply mode of second bias power source 248 may be either the constant current control or the constant voltage control. It should be noted that, to securely ensure a potential difference, the constant voltage control is preferable.

In response to a control signal from control section 100, second bias power source 248 applies a positive bias voltage to second collecting roller 244. That is, the potentials of second cleaning roller 242 and second collecting roller 244 are set to potentials having the same (positive polarity) polarity and different values. Thus, between second cleaning roller 242 and second collecting roller 244, an electrostatic force in the direction from second cleaning roller 242 toward second collecting roller 244 acts on positively and oppositely charged toner 190. Toner 190 that has moved to second collecting roller 244 is scraped from the surface of second collecting roller 244 by second scraper 246.

Figure 4A:
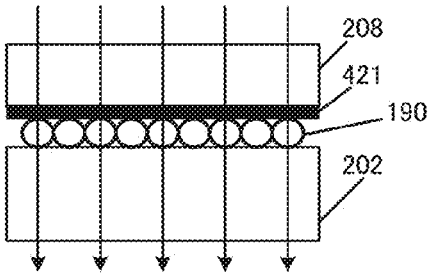
FIGS. 4A to 4D each illustrate an oppositely charging function in a pre-cleaning section.
Figure 4B:
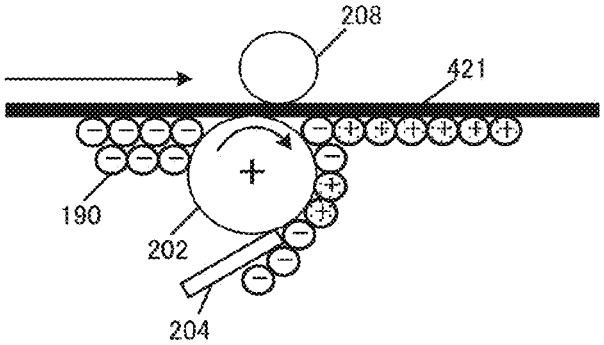

In the present embodiment, pre-bias power source 206 applies a voltage having a polarity (positive polarity) opposite to the regular charging polarity of toner 190 to pre-cleaning roller 202 such that toner 190 having negative polarity (regular charging polarity) is electrostatically attached to pre-cleaning roller 202 from intermediate transfer belt 421, and that toner 190 passing over pre-cleaning roller 202 is oppositely charged to positive polarity from negative polarity. FIG. 4A illustrates a state where an electrostatic force in the direction from intermediate transfer belt 421 toward pre-cleaning roller 202 (in the drawing, arrow direction) acts on negative toner 190 remaining on intermediate transfer belt 421. FIG. 4B illustrates a state where toner 190 that has passed through pre-cleaning roller 202 without being removed by pre-cleaning roller 202 is oppositely charged from negative polarity to positive polarity. In this manner, toner 190 having a charging distribution suitable for brush cleaning can be supplied to first cleaning roller 222, and consequently stable cleaning performance in belt cleaning device 426 can be ensured.

Figure 5A:
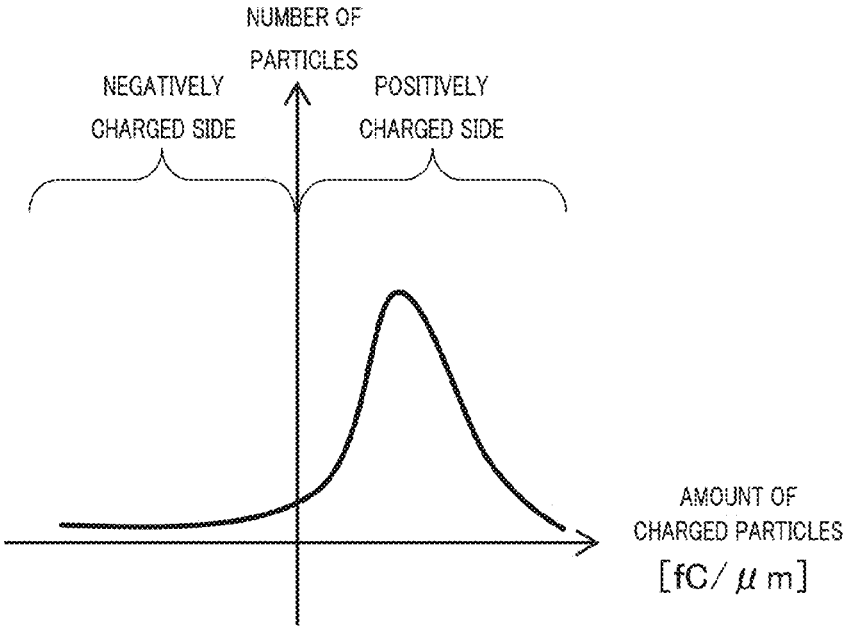
FIGS. 5A and 5B are diagrams for describing an opposite charge ratio of toner that has passed through a pre-cleaning roller.
Figure 5B:
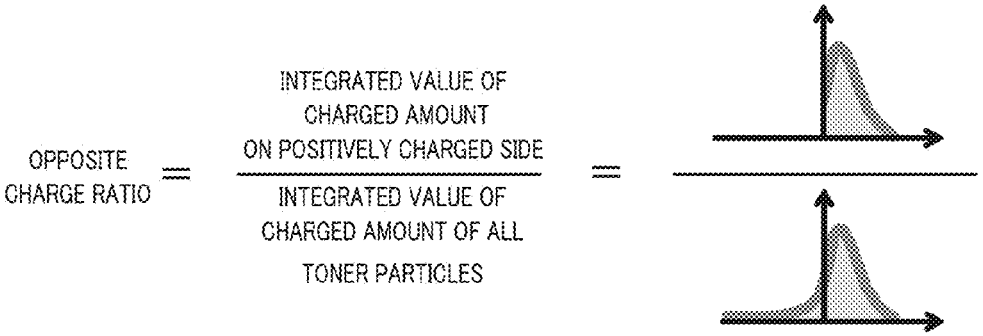

Here, the charging distribution suitable for brush cleaning is a charging distribution in which the opposite charge ratio of toner 190 that has passed through pre-cleaning roller 202 is 65[%] or above, for example. The opposite charge ratio is a ratio of a value obtained by integrating the charged amount of all the collected toner particles to a value obtained by integrating the charged amount on positive polarity side with respect to the point where the charged amount is 0, when toner 190 that has passed through pre-cleaning roller 202 is collected and the charged amount distribution indicating the relationship between the charged amount of particles [fC/μm] and the number distribution of the particles (see FIG. 5A) is measured by E-spart method (see FIG. 5B).

Figure 4C:
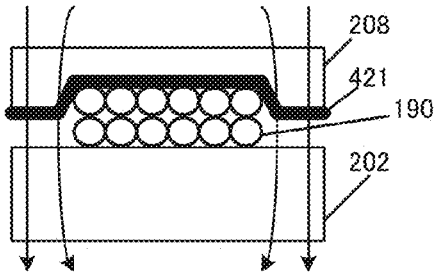
Figure 4D:
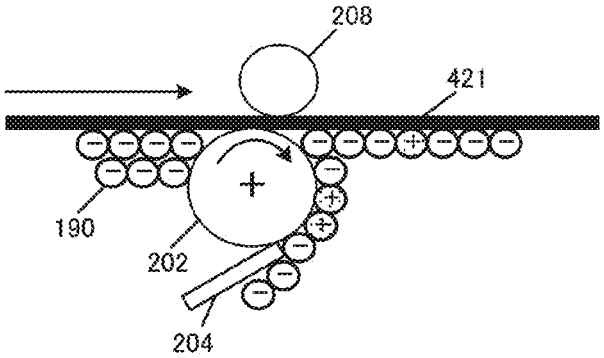

However, when a predetermined cleaning condition is satisfied, the function of oppositely charging negative toner 190 of toner 190 passing over pre-cleaning roller 202 to positive polarity is impaired. FIG. 4C illustrates a state where an electrostatic force in a direction from intermediate transfer belt 421 toward pre-cleaning roller 202 (in the drawing, arrow direction) acts on negative toner 190 remaining on intermediate transfer belt 421. FIG. 4D illustrates a state where toner 190 that has passed through pre-cleaning roller 202 without being removed by pre-cleaning roller 202 is not oppositely charged from negative polarity to positive polarity.

Examples of the predetermined cleaning condition include a case where the belt width of toner 190 is 100 [mm] or smaller, a case where the amount of attached toner 190 is 6 [g/m$^2$] or greater, and a case where the temperature and humidity around belt cleaning device 426 are respectively 10[° C.] or below and 20[%] or below (that is, LL environment). The resistance of toner 190 is high, and therefore, when the belt width of toner 190 is small, current concentrates at the regions other than the toner layer (toner 190), and electrostatic discharge does not occur at the region of the toner layer (see FIG. 4C). Consequently, the function of oppositely charging toner 190 that has passed through pre-cleaning roller 202 is impaired. In addition, when the amount of attached toner 190 is great, electrostatic discharge does not reach the entirety of the toner layer, and this makes it difficult to oppositely charge toner 190 that has passed through pre-cleaning roller 202 by pre-cleaning roller 202. In addition, under the LL environment, the charged amount of toner 190 that has been charged to negative polarity (regular charging polarity) is great, and therefore a large amount of electric energy is required to oppositely charge toner 190.

When the function of oppositely charging toner 190 is impaired, a large amount of negatively charged toner 190 enters second cleaning roller 242 disposed on the downstream side of first cleaning section 220 in the traveling direction of intermediate transfer belt 421. In this case, electrostatic discharge occurs between second cleaning roller 242 and toner 190, and weak charging of toner 190 easily occurs at a location on the inner side of second cleaning roller 242. Disadvantageously, toner 190 thus weakly charged is again attached to the surface of intermediate transfer belt 421 from second cleaning roller 242 side by the impact caused between second cleaning roller 242 and intermediate transfer belt 421, and by the influence of the charging potential of intermediate transfer belt 421. Consequently, favorable cleaning for intermediate transfer belt 421 cannot be achieved.

In the present embodiment, when the above-mentioned predetermined cleaning condition is satisfied, first bias power source 228 applies a positive bias voltage to first cleaning roller 222 and first collecting roller 224 in response to a control signal from control section 100. That is, first bias power source 228 inverts the polarity of the bias voltage applied to first cleaning roller 222 and first collecting roller 224. Further, second bias power source 248 applies a negative bias voltage to second cleaning roller 242 and second collecting roller 244 in response to a control signal from control section 100. That is, second bias power source 248 inverts the polarity of the bias voltage applied to second cleaning roller 242 and second collecting roller 244.

In this manner, charged toner 190 that has passed through pre-cleaning roller 202 but has not been oppositely charged and thus kept at negative polarity is removed by first cleaning roller 222 whose bias voltage polarity is inverted from negative to positive. Even if weak charging of toner 190 occurs at a location on the inner side of first cleaning roller 222 (cleaning brush roller), and toner 190 thus weakly charged again attaches to the surface of intermediate transfer belt 421 from first cleaning roller 222 side, a small amount of toner 190 thus attached is mechanically removed by second cleaning roller 242 disposed on the downstream side of first cleaning roller 222. In addition, by second cleaning roller 242 whose bias voltage polarity is inverted from positive to negative, originally positively (polarity opposite to the regular charging polarity) charged toner 190 is electrically removed. Thus, favorable cleaning for intermediate transfer belt 421 can be achieved.

Figure 6:
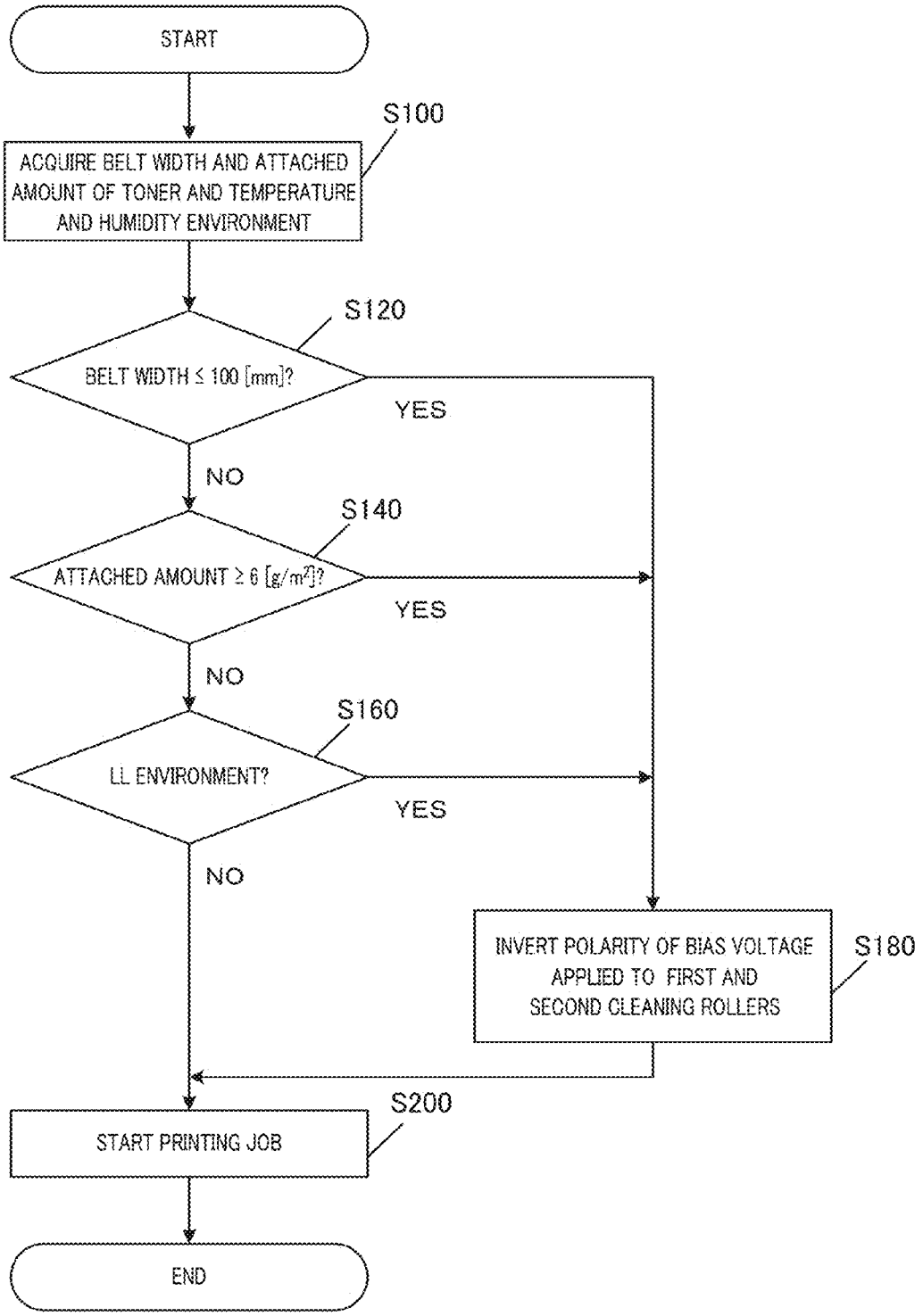
FIG. 6 is a flowchart of an exemplary operation of the image forming apparatus of the present embodiment.

Next, referring to the flowchart of FIG. 6, an exemplary operation of image forming apparatus 1 will be described. The processes illustrated in FIG. 6 are performed prior to the printing job. For example, the processes illustrated in FIG. 6 are performed at the time of, after a test patch is formed on intermediate transfer belt 421, performing an image stabilization control on the basis of results of detection of the concentration of the formed test patch. It is to be noted that, in this case, prior to step S100, a positive bias voltage is applied to first cleaning roller 222 and first collecting roller 224, and a negative bias voltage is applied to second cleaning roller 242 and second collecting roller 244.

First, control section 100 refers to image data of a test patch to be formed on intermediate transfer belt 421, obtains the belt width and attached amount of toner 190 remaining on intermediate transfer belt 421, and obtains the temperature and humidity around belt cleaning device 426 on the basis of temperature-and-humidity information output from temperature-and-humidity detection sensor 80 (step S100).

Next, control section 100 determines whether the belt width of toner 190 remaining on intermediate transfer belt 421 is not greater than 100 [mm] (step S120). When it is determined that the belt width of toner 190 is not greater than 100 [mm] (step S120, YES), the process is advanced to step S180. On the other hand, when the belt width of toner 190 is greater than 100 [mm] (step S120, NO), control section 100 determines whether the amount of attached toner 190 remaining on intermediate transfer belt 421 is not smaller than 6 [g/m$^2$] (step S140). When it is determined that the amount of attached toner 190 is not smaller than 6 [g/m$^2$] (step S140, YES), the process is advanced to step S180.

On the other hand, when the amount of attached toner 190 is smaller than 6 [g/m$^2$] (step S140, NO), control section 100 determines whether the temperature and humidity around belt cleaning device 426 are not greater than 10 [° C.] and not greater than 20 [%], respectively (that is, whether the LL environment is established) (step S160). When it is determined that the LL environment is established (step S160, YES), control section 100 controls first bias power source 228 to invert the polarity of the bias voltage to be applied to first cleaning roller 222 and first collecting roller 224, and controls second bias power source 248 to invert the polarity of the bias voltage to be applied to second cleaning roller 242 and second collecting roller 244 (step S180). Thereafter, the process is advanced to step S200.

On the other hand, when the LL environment is not established (step S160, NO), control section 100 starts the printing job (step S200). Upon completion of the process of step S200, image forming apparatus 1 terminates the processes of FIG. 6.

As has been described in detail, in the present embodiment, brush bristles are not provided on the periphery of belt cleaning device 426, and belt cleaning device 426 includes pre-cleaning section 200 and first cleaning section 220. Pre-cleaning section 200 includes pre-cleaning roller 202 configured to remove toner 190 remaining on intermediate transfer belt 421, and pre-bias power source 206 configured to apply a voltage having a polarity opposite to the regular charging polarity of toner 190 to pre-cleaning roller 202 such that toner 190 having the regular charging polarity electrostatically attaches to pre-cleaning roller 202 from intermediate transfer belt 421, and that toner 190 passing over pre-cleaning roller 202 is oppositely charged to the polarity opposite to the regular charging polarity. First cleaning section 220 includes first cleaning roller 222 disposed on a downstream side of pre-cleaning roller 202 in the traveling direction of intermediate transfer belt 421 and configured to remove toner 190 remaining on intermediate transfer belt 421, and first bias power source 228 configured to apply a voltage having a polarity identical to the regular charging polarity of toner 190 to first cleaning roller 222 such that toner 190 having the polarity opposite to the regular charging polarity attaches to first cleaning roller 222 from intermediate transfer belt 421, first bias power source 228 being configured to apply a voltage having the polarity opposite to the regular charging polarity of toner 190 to first cleaning roller 222 such that the toner having the polarity identical to the regular charging polarity electrostatically attaches to first cleaning roller 222 from intermediate transfer belt 421 only when a predetermined cleaning condition is satisfied.

According to the above-mentioned configuration of the present embodiment, when a predetermined cleaning condition is satisfied, toner 190 that has passed through pre-cleaning roller 202 but has not been oppositely charged and thus kept at negative polarity is removed by first cleaning roller 222 whose bias voltage polarity is inverted. Even if weak charging of toner 190 occurs at a location on the inner side of first cleaning roller 222 (cleaning brush roller), and toner 190 thus weakly charged again attaches on the surface of intermediate transfer belt 421 from first cleaning roller 222 side, a small amount of toner 190 thus attached is mechanically removed by second cleaning roller 242 disposed on the downstream side of first cleaning roller 222. Additionally, pre-cleaning roller 202 is not a cleaning brush roller, and removes a large amount of negatively (regular charging polarity) charged toner 190 (80[%] of toner 190 that enters pre-cleaning roller 202, for example) at a stage preceding first cleaning roller 222. Thus, weak charging of toner 190 at pre-cleaning roller 202 can be prevented. In addition, since the amount of toner 190 that enters first cleaning roller 222 is small, the amount of toner 190 that is weakly charged at first cleaning roller 222 can be minimized. Originally positively (polarity opposite to the regular charging polarity) charged toner 190 is electrically removed by second cleaning roller 242 whose bias voltage polarity is inverted from positive to negative. Thus, it is possible to achieve favorable cleaning for intermediate transfer belt 421 on which a large amount of toner remains.

While, in the above-mentioned embodiment, intermediate transfer belt 421 corresponds to the "transfer belt" of the embodiment of the present invention, the present invention is not limited to this. For example, when image forming apparatus 1 includes a secondary transfer belt configured to transfer toner 190 on intermediate transfer belt 421 to a sheet, the secondary transfer belt may correspond to the "transfer belt" of the embodiment of the present invention. In this case, toner 190 which has not been transferred to sheet S by the transfer operation and remains on the secondary transfer belt when, for example, a conveyance defect (jam) of sheet S occurs can be appropriately removed by applying the present invention.

While second cleaning section 240 disposed on the downstream side of first cleaning section 220 in the traveling direction of intermediate transfer belt 421 has been described in the above-mentioned embodiment, second cleaning section 240 may not be disposed. It should be noted that it is preferable to dispose second cleaning section 240 on the downstream side of first cleaning section 220 from the view point of achieving favorable cleaning for intermediate transfer belt 421 by electrically removing a small amount of originally positively charged toner 190, and by mechanically removing a small amount of toner 190 again attached on the surface of intermediate transfer belt 421 from first cleaning roller 222 side, when a predetermined cleaning condition is satisfied.

While, in the above-mentioned embodiment, when an image stabilization control is performed on the basis of the results of detection of concentration of a test patch, the polarity of the bias voltage applied to first cleaning roller 222 and first collecting roller 224 is inverted, and the polarity of the bias voltage applied to second cleaning roller 242 and second collecting roller 244 is inverted, the present invention is not limited to this. Under a circumstance where a large amount of toner remaining on intermediate transfer belt 421 is removed by belt cleaning device 426 (for example, when a conveyance defect (jam) of sheet S occurs), the polarity of the bias voltage applied to first cleaning roller 222 and first collecting roller 224 and the polarity of the bias voltage applied to second cleaning roller 242 and second collecting roller 244 may be inverted, when a predetermined cleaning condition is satisfied.

In addition, in the above-mentioned embodiment, brush bristles may be provided on the periphery of pre-cleaning roller 202. In this case, the cleaning condition where the function of oppositely charging negative toner 190 to positive polarity by pre-cleaning roller 202 is impaired may possibly be different from the above-described cleaning condition. It is preferable that no brush bristle be provided on the periphery of pre-cleaning roller 202 from the viewpoint of preventing weak charging of toner 190 at pre-cleaning roller 202.

The embodiments disclosed herein are merely exemplifications and should not be considered as limitative. While the invention made by the present inventor has been specifically described based on the preferred embodiments, it is not intended to limit the present invention to the above-mentioned preferred embodiments but the present invention may be further modified within the scope and spirit of the invention defined by the appended claims.

What is claimed is:

1. A cleaning device comprising:

a pre-cleaning section and a first cleaning section, the pre-cleaning section including a pre-cleaning roller configured to remove toner remaining on a transfer belt, and a pre-cleaning voltage applying section configured to apply a voltage having a polarity opposite to a regular charging polarity of the toner to the pre-cleaning roller such that the toner having the regular charging polarity electrostatically attaches to the pre-cleaning roller from the transfer belt, and that the toner passing over the pre-cleaning roller is oppositely charged to the polarity opposite to the regular charging polarity, the first cleaning section including a first cleaning roller disposed on a downstream side of the pre-cleaning roller in a traveling direction of the transfer belt, the first cleaning roller being configured to remove toner remaining on the transfer belt, and a first cleaning voltage applying section configured to apply a voltage having a polarity identical to the regular charging polarity of the toner to the first cleaning roller prior to removing toner from the transfer belt such that the toner having the polarity opposite to the regular charging polarity attaches to the first cleaning roller from the transfer belt when a predetermined cleaning condition is not satisfied, the first cleaning voltage applying section being configured to apply a voltage having the polarity opposite to the regular charging polarity of the toner to the first cleaning roller prior to removing toner from the transfer belt such that the toner having the polarity identical to the regular charging polarity electrostatically attaches to the first cleaning roller from the transfer belt when the predetermined cleaning condition is satisfied.

2. The cleaning device according to claim 1, wherein brush bristles are not provided on a periphery of the pre-cleaning roller.

3. The cleaning device according to claim 1, wherein the cleaning condition is that a width of the toner is 100 mm or smaller.

4. The cleaning device according to claim 1, wherein the cleaning condition is that an attached amount of the toner is 6 $g/m^2$ or more.

5. The cleaning device according to claim 1, wherein the cleaning condition is that a temperature around the cleaning device is 10° C. or below, and that a humidity around the cleaning device is 20% or below.

6. The cleaning device according to claim 1, wherein the first cleaning roller is a cleaning brush roller.

7. The cleaning device according to claim 1, wherein the first cleaning roller makes contact with a surface of the transfer belt, and rotates in a counter direction opposite to the traveling direction of the transfer belt.

8. The cleaning device according to claim 1, wherein the first cleaning section includes a first cleaning counter roller that is so arranged as to make pressure contact with the transfer belt at a predetermined position, and to face the first cleaning roller with the transfer belt therebetween.

9. The cleaning device according to claim 1 further comprising a second cleaning section, the second cleaning section including a second cleaning roller disposed on a downstream side of the first cleaning roller in the traveling direction of the transfer belt, the second cleaning roller being configured to remove toner remaining on the transfer belt, and a second cleaning voltage applying section configured to apply a voltage having the polarity opposite to the regular charging polarity of the toner to the second cleaning roller such that the toner having the polarity identical to the regular charging polarity attaches to the second cleaning roller from the transfer belt, the second cleaning voltage applying section being configured to apply a voltage having the polarity identical to the regular charging polarity of the toner to the second cleaning roller such that the toner having the polarity opposite to the regular charging polarity electrostatically attaches to the second cleaning roller from the transfer belt only when a predetermined cleaning condition is satisfied.

10. The cleaning device according to claim 9, wherein the second cleaning roller is a cleaning brush roller.

11. The cleaning device according to claim 9, wherein the second cleaning roller makes contact with a surface of the transfer belt, and rotates in a counter direction opposite to the traveling direction of the transfer belt.

12. The cleaning device according to claim 9, wherein the second cleaning section includes a second cleaning counter roller that is so arranged as to make pressure contact with the transfer belt at a predetermined position, and to face the second cleaning roller with the transfer belt therebetween.

13. An image forming apparatus comprising: a pre-cleaning section and a first cleaning section, the pre-cleaning section including a pre-cleaning roller configured to remove toner remaining on a transfer belt, and a pre-cleaning voltage applying section configured to apply a voltage having a polarity opposite to a regular charging polarity of the toner to the pre-cleaning roller such that the toner having the regular charging polarity electrostatically attaches to the pre-cleaning roller from the transfer belt, and that the toner passing over the pre-cleaning roller is oppositely charged to the polarity opposite to the regular charging polarity, the first cleaning section including a first cleaning roller disposed on a downstream side of the pre-cleaning roller in a traveling direction of the transfer belt, the first cleaning roller being configured to remove toner remaining on the transfer belt, and a first cleaning voltage applying section configured to apply a voltage having a polarity identical to the regular charging polarity of the toner to the first cleaning roller prior to removing toner from the transfer belt such that the toner having the polarity opposite to the regular charging polarity attaches to the first cleaning roller from the transfer belt when a predetermined cleaning condition is not satisfied, the first cleaning voltage applying section being configured to apply a voltage having the polarity opposite to the regular charging polarity of the toner to the first cleaning roller prior to removing toner from the transfer belt such that the toner having the polarity identical to the regular charging polarity electrostatically attaches to the first cleaning roller from the transfer belt when the predetermined cleaning condition is satisfied.

14. The image forming apparatus according to claim 13, wherein brush bristles are not provided on a periphery of the pre-cleaning roller.

15. The image forming apparatus according to claim 13, wherein the cleaning condition is that a width of the toner is 100 mm or smaller.

16. The image forming apparatus according to claim 13, wherein the cleaning condition is that an attached amount of the toner is 6 $g/m^2$ or more.

17. The image forming apparatus according to claim 13, wherein the cleaning condition is that a temperature around the image forming apparatus is 10° C. or below, and that a humidity around the image forming apparatus is 20% or below.

18. The image forming apparatus according to claim 13, wherein the first cleaning roller is a cleaning brush roller.

19. The image forming apparatus according to claim 13 further comprising a second cleaning section, the second cleaning section including a second cleaning roller disposed on a downstream side of the first cleaning roller in the traveling direction of the transfer belt, the second cleaning roller being configured to remove toner remaining on the transfer belt, and a second cleaning voltage applying section configured to apply a voltage having the polarity opposite to the regular charging polarity of the toner to the second cleaning roller such that the toner having the polarity identical to the regular charging polarity attaches to the second cleaning roller from the transfer belt, the second cleaning voltage applying section being configured to apply a voltage having the polarity identical to the regular charging polarity of the toner to the second cleaning roller such that the toner having the polarity opposite to the regular charging polarity electrostatically attaches to the second cleaning roller from the transfer belt only when a predetermined cleaning condition is satisfied.

20. The image forming apparatus according to claim 19, wherein the second cleaning roller is a cleaning brush roller.

* * * * *